US011160345B2

(12) United States Patent
Riley

(10) Patent No.: US 11,160,345 B2
(45) Date of Patent: Nov. 2, 2021

(54) BAG FOR PERSONAL ITEMS

(71) Applicant: Judith Reichel Riley, Mooresville, NC (US)

(72) Inventor: Judith Reichel Riley, Mooresville, NC (US)

( * ) Notice: Subject to any disclaimer, the term of this patent is extended or adjusted under 35 U.S.C. 154(b) by 0 days.

(21) Appl. No.: 16/299,378

(22) Filed: Mar. 12, 2019

(65) Prior Publication Data

US 2019/0274404 A1 Sep. 12, 2019

Related U.S. Application Data

(60) Provisional application No. 62/641,686, filed on Mar. 12, 2018.

(51) Int. Cl.

| | |
|---|---|
| ***B65D 33/28*** | (2006.01) |
| ***A45C 13/02*** | (2006.01) |
| ***A45C 13/10*** | (2006.01) |
| ***A45C 3/00*** | (2006.01) |
| ***A45C 11/24*** | (2006.01) |
| ***B65D 33/01*** | (2006.01) |
| ***B65D 33/04*** | (2006.01) |
| ***B65D 33/02*** | (2006.01) |

(52) U.S. Cl.

CPC ..... *A45C 13/02* (2013.01); *A45C 3/001* (2013.01); *A45C 11/24* (2013.01); *A45C 13/1046* (2013.01); *B65D 33/01* (2013.01); *B65D 33/02* (2013.01); *B65D 33/04* (2013.01); *B65D 33/28* (2013.01); *A45C 2003/002* (2013.01); *A45C 2003/008* (2013.01); *A45C 2200/10* (2013.01)

(58) Field of Classification Search

CPC ..... B65D 33/28; A45C 3/001; A45C 13/02; A45C 2001/086; A45C 11/14; E01H 2001/128

USPC ..... 383/38–40, 71–77, 61.4, 109, 114, 41; 294/1.3; 224/682

See application file for complete search history.

(56) References Cited

U.S. PATENT DOCUMENTS

| | | | | |
|---|---|---|---|---|
| 1,681,922 | A * | 8/1928 | Boch | A45C 3/00 383/39 |
| 5,251,743 | A * | 10/1993 | Pulido | A45C 3/04 206/37.1 |
| 5,316,388 | A * | 5/1994 | Caligiuri | A45C 11/20 383/127 |
| 6,287,002 | B1 * | 9/2001 | Sherman | A45C 13/1046 383/24 |
| D464,179 | S | 10/2002 | Petersen et al. | |
| 7,083,331 | B2 | 8/2006 | Nykoluk | |
| 8,801,286 | B2 * | 8/2014 | Tatsuno | A47G 9/086 383/117 |
| 9,445,575 | B2 | 9/2016 | Ferguson | |
| 2018/0255893 | A1 * | 9/2018 | Godshaw | A45C 1/02 |

* cited by examiner

*Primary Examiner* — Jes F Pascua
*Assistant Examiner* — Nina K Attel

(57) ABSTRACT

A flexible, two-part bag. The bag has a first outer section for containing common toiletry items, such as toothpaste, toothbrush, floss, etc., including a small shovel, clean toilet paper, or package of moist wipes etc. The walls of the first outer section are preferably of transparent material or netting material to enable viewing of the contents. A second center section, formed inside the first outer section, and extending slightly above the first section, enables the contents of the sections to be separated, such that the bag forms at least two compartments.

12 Claims, 7 Drawing Sheets

BAG FOR PERSONAL ITEMS

FIELD OF THE INVENTION

The present invention relates to a lightweight bag for carrying personal items, and more particularly to a bag for toiletry items used for washing and grooming, and especially when using an outdoor privy or primitive bathroom facilities, as well as for carrying away trash materials following use.

BACKGROUND

Visitors to wilderness areas have been increasing since the establishment of National Parks and dedicated wilderness areas across the United States, and internationally. Although the federal government has requested visitors to have a minimal impact on the land, from the 1970's to the 1990's, additional education and advocacy groups, such as the Boy Scouts of America and Sierra Club, began to train members in outdoor ethics. Eventually, a national education program entitled "Leave No Trace" was developed, and numerous United States government departments, bureaus and services adopted and educate the public in Leave No Trace principles.

The Leave No Trace principles provide seven "rules" for outdoor recreation decision making: Plan ahead and prepare; Travel and camp on durable surfaces; Dispose of waste properly; Leave what you find; Minimize campfire impacts; Respect wildlife; and Be considerate of other visitors.

Today, a shortened version, encapsulating the Leave No Trace rules has also become more commonly known to scouts and the general public, as it is easy to remember: "Take Only Pictures, Leave Only Footprints." "Leaving only footprints" means trash and litter must not be left behind to spoil natural areas or cause environmental damage. In backcountry wilderness areas where no trash receptacles are provided, visitors should carry out all trash they have brought in.

Wilderness camping generates food waste, paper waste and fecal waste which must be properly disposed of according to Leave No Trace principles. Although urinating in the woods is not a violation of Leave No Trace, fecal waste must be left in an appropriate privy, or buried in a "cat hole" dug to a proper depth and a prescribed distance from a path or site. However, used toilet paper, feminine hygiene protection items, and moist wipes, are all forms of paper or toilet trash that must be carried out, along with other food related trash. Unfortunately, few tools or types of ultra light weight equipment are available to manage such trash materials easily, conveniently and discretely. Additionally, the containment of toilet trash separately from food trash materials is desirable for a variety of reasons, including encouraging proper Leave No Trace behavior and for more discrete management of toilet trash. The convenient use of hand sanitizer may assist with the prevention of common illnesses resulting from poor sanitation or poor personal hygiene, such as Norovirus. Norovirus is a highly contagious avoidable illness with severe symptoms best avoided by the use of careful sanitation and hygiene. Still further, there is currently no tool or single item of equipment available for combining, organizing and storing all the necessary toilet items used for wilderness bathroom activities, including washing and grooming, as well as toilet trash storage.

SUMMARY

This application provides a lightweight, flexible, two-part or two compartment bag for personal items. The bag has a first outer section or compartment for containing common personal items, for example toiletry items such as toothpaste, toothbrush, floss, etc., but also optionally able to include a small shovel, clean toilet paper, a package of moist wipes, a roll of disposable bags, etc., or any items desired for use with grooming or cleaning at a cat hole, privy or bathroom facilities. The walls of the first outer section are preferably of transparent material or netting material to enable viewing of the contents within the first outer section. A second center section or compartment, formed inside the first outer section, and with an opening to the compartment extending slightly above the first outer section, enables the contents of the sections to be separated, such that the bag forms two distinct, separable or contained sections, areas or compartments. The walls of the second center section are preferably of opaque, nylon, rip stop parachute material, for discretely housing either a separate and removable, resealable container for used toilet paper, wipes and tampons, or for these soiled paper or toilet waste materials directly. The importance of using ultra light weight materials cannot be underestimated. Using super ultra light weight materials to make the bag as light as possible reduces equipment weight, which is very important for backpacking. A reduction in weight by even 1 ounce is a highly valuable weight savings for backpackers. The separate container may be a resealable plastic bag, such as a disposable Ziploc® bag. By hiding and sealing toilet waste materials from view and smell within a disposable bag inside the opaque second center section, such waste materials are more easily and discretely managed and carried away from a wilderness site for proper disposal later.

Each of the first outer and second center sections has a drawstring opening surrounded by a channel housing the drawstring. The walls of the first outer and second center sections are each secured along a shared or common, reinforced bottom, and at least at one location below and adjacent the drawstring openings. The bottom may be a variety of shapes, such as oval, rectangular, circular or square, and may be of a single panel construction or a multiple panel construction.

Loop hangers are secured at various locations sewn within the seams of the first outer section, so the bag may be hung from a backpack, a tree branch or a hook within a restroom stall. Other items desired to be conveniently available may be hung from loop hangers, such as a holder for a roll of disposable bags or a container of hand sanitizer. Additionally, capturing toilet trash materials and using hand sanitizer promotes better sanitation and personal hygiene, which in turn may prevent illness.

In an alternate embodiment, a pocket may be provided on an outer surface of the bottom to house additional equipment, or a small roll of disposable bags or dog waste removal bags.

DETAILED DESCRIPTION

Figure 1:
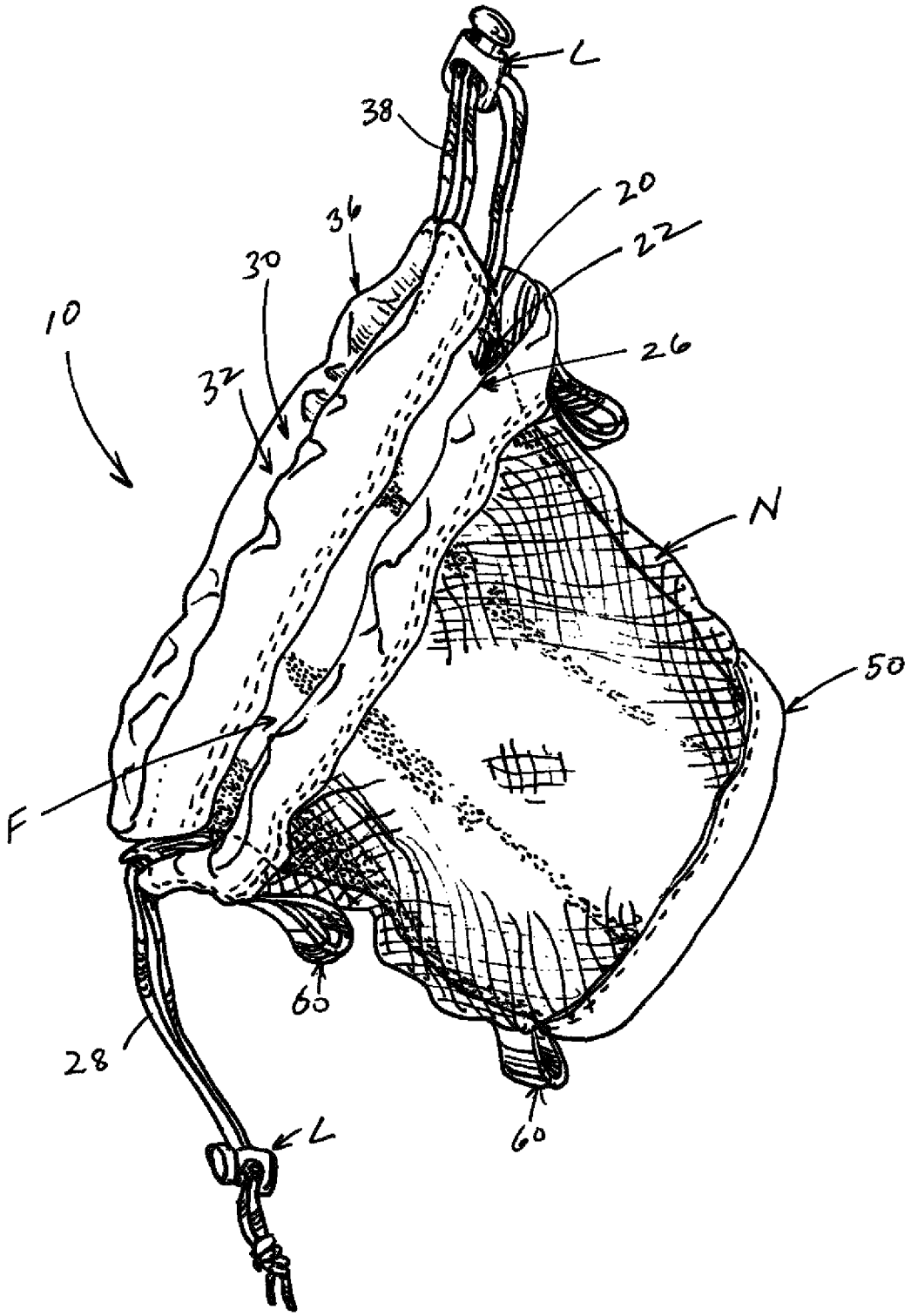
FIG. 1 shows a perspective view of the lightweight bag of this application where the openings of both the first outer section and the second center section are shown in open position.

As shown in FIG. 1, the lightweight, flexible, two-part or two compartment bag 10 for personal items P includes a first outer section or compartment 20 having an open top 22 which may be closed for containing personal items. Examples of personal toiletry items P to be contained include toothpaste, toothbrush, floss, etc., and may also include items such as a small shovel, clean toilet paper, a package of moist wipes, feminine hygiene protection items, a roll of disposable bags, etc., or any items desired for use with grooming or cleaning at a cat hole, privy or bathroom facilities. The wall 24 of the first outer section 20 is preferably of transparent material or lightweight open netting material N to enable viewing of the contents within the first outer section.

Figure 2:
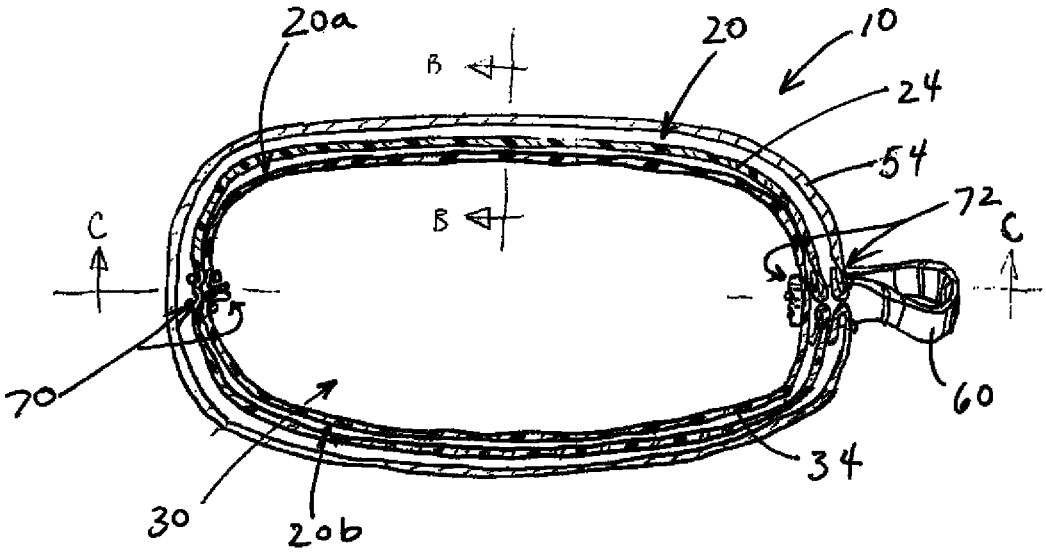
FIG. 2 is a cut-away view taken along the line A-A of FIG. 4, showing internal aspects of the lightweight bag of FIG. 1.
Figure 3:
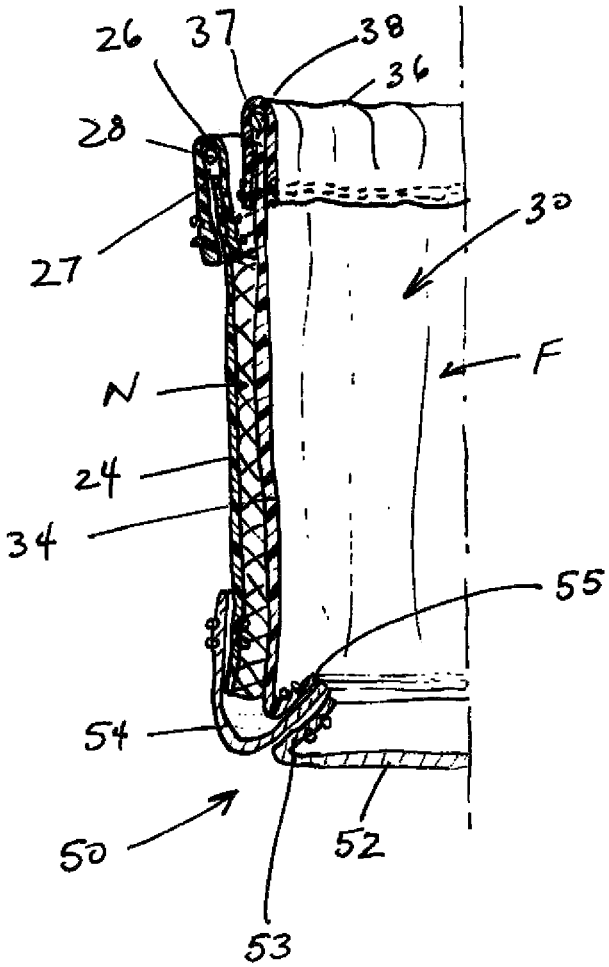
FIG. 3 is a cut-away view taken along the line B-B of FIG. 2, showing internal aspects of the lightweight bag of FIG. 1.

A second center section or compartment 30 is also provided, and includes an open top 32 that may be closed. As shown in FIG. 2, the second center section 30 is formed by a wall 34 positioned substantially within or inside the first outer section 20, or with only a portion of the open top 32 projecting from the first outer section, as shown in FIGS. 1 and 3-8. The open top or opening 32 to the second center section compartment extends slightly above the open top or opening 22 to the first outer section, as further shown in FIGS. 3-8, and enables the contents of the sections to be separated, such that the bag forms two distinct, separable or contained sections, areas or compartments 20, 30.

Figure 10:
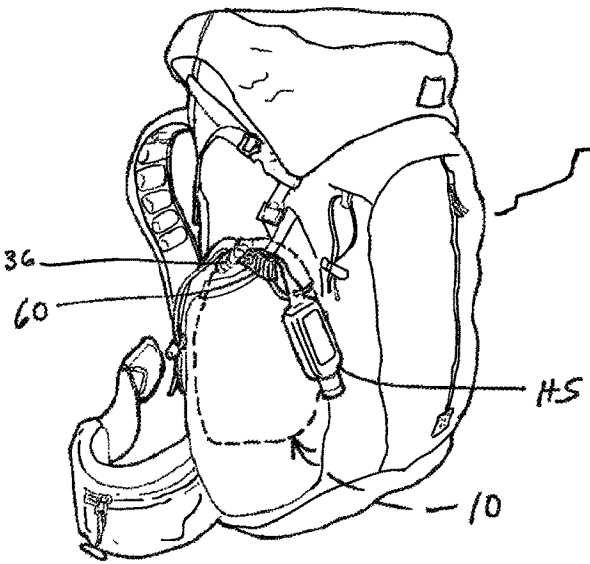
FIG. 10 shows a perspective view of a backpack having the bag contained within an external pocket of the backpack, but with the sanitizer attached to the bag extending from the external pocket for ease of use, and where the openings of both the first outer section and the second center section are closed to contain the personal items within the bag.
Figure 9:
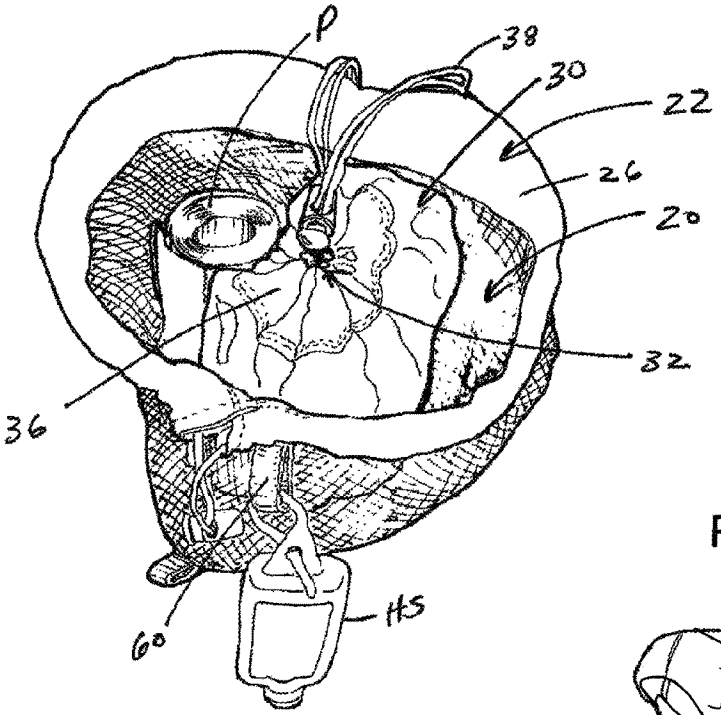
FIG. 9 shows a perspective top angle view of the bag of FIG. 1 with an illustration of a container of sanitizer removably attached to a loop hanger extending near the open drawstring opening of the first outer section, and where the first outer section is open and the second center section is closed, and personal items may be seen contained within one side of the first outer section through the wall of the first outer section.

Each of the first outer and second center section open tops or openings 22, 32 is formed by a drawstring opening 26, 36 which is surrounded by a channel 27, 37 housing a drawstring 28, 38, respectively. Drawstrings 28, 38 extend or exit from the respective channels 27, 37 at spaced or opposite positions around the open tops of the first outer and second center sections 20, 30. Locating the exit of the drawstrings at opposite positions around the openings 22, 32 of the first outer and second center sections 20, 30 avoids confusion between, or tangling of, the drawstrings 28, 38. The ends 29, 39 of each drawstring 28, 38 may be tied together, or may optionally be retained by a plastic toggle spring stop string cord lock L. The toggle spring stop cord lock may be of a single hole variety, for clamping the drawstring opening in a closed position. To move the open tops or openings 22, 32 from an open position to a closed position, the drawstrings are pulled within the channels to bunch the drawstring opening together and close the open top, as shown in FIG. 9, or provide the sections in a closed position. Either of the open tops or openings of the sections may be opened or closed to either desired position as necessary during use of the bag. When both of the first outer and second center section drawstring openings 26, 36 are closed, the second center section is contained or positioned entirely within the first outer section, as shown in FIG. 10.

Figure 4:
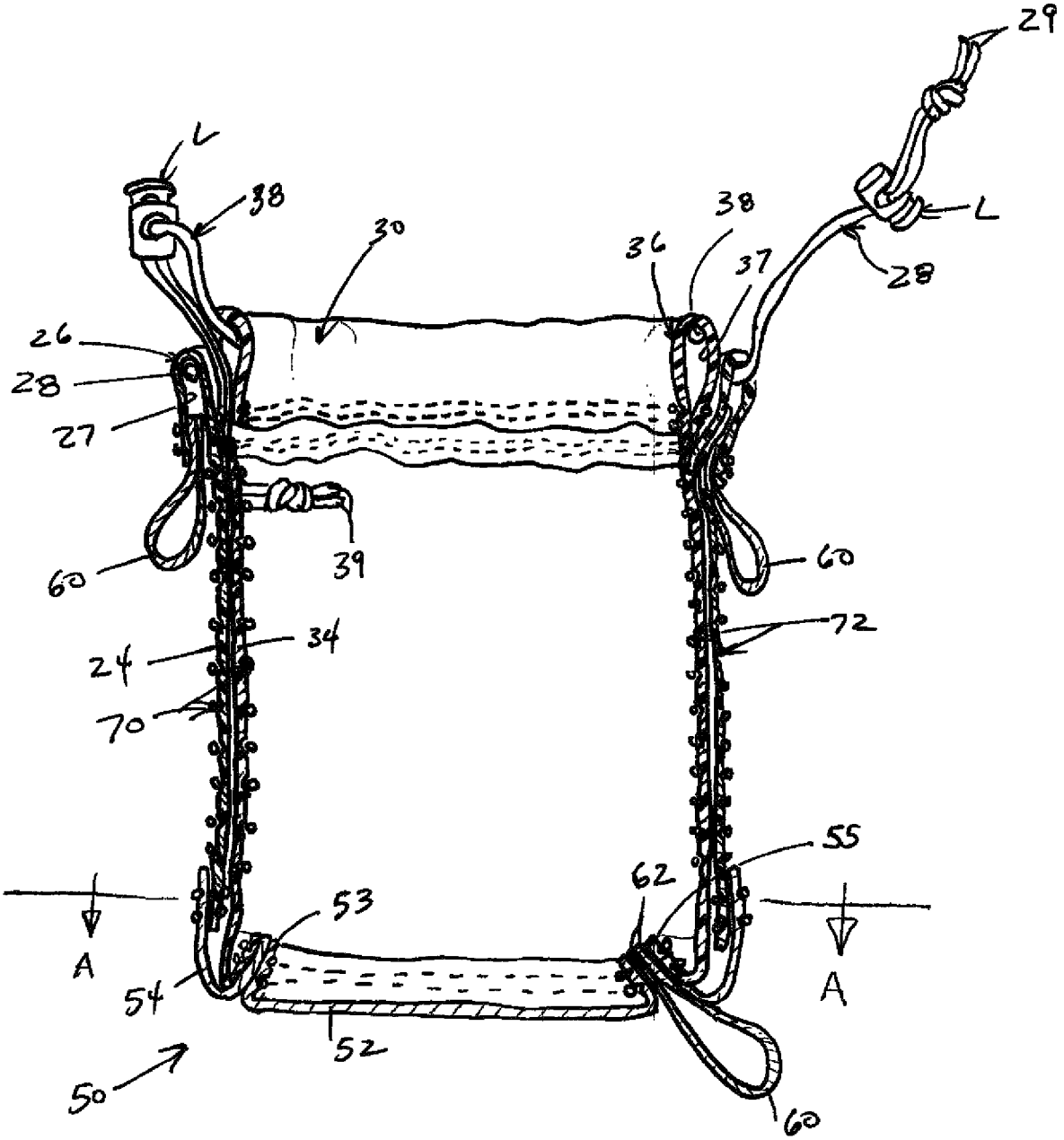
FIG. 4 is a cut-away view taken along the line C-C of FIG. 2, showing internal aspects of the lightweight bag of FIG. 1.
Figure 5:
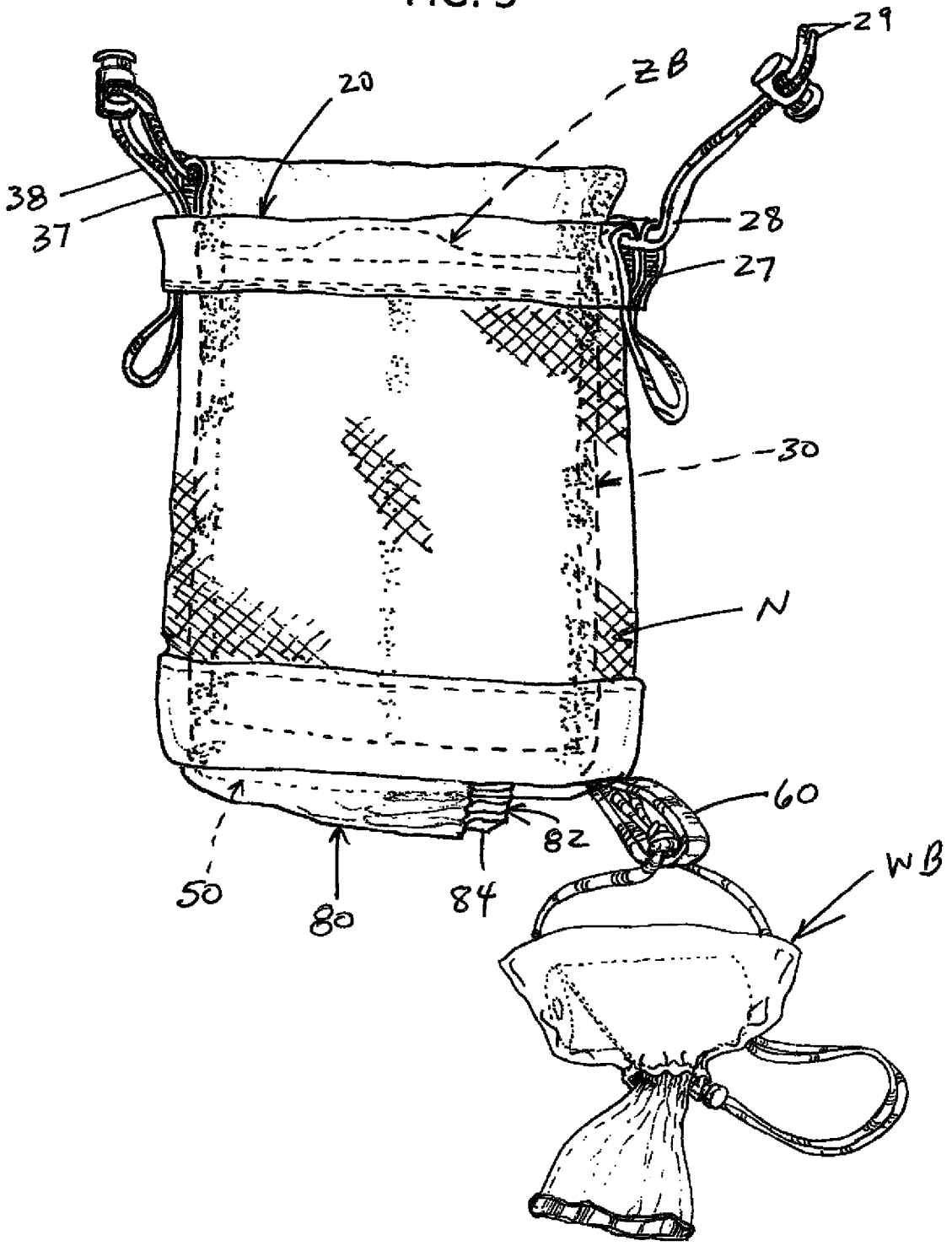
FIG. 5 shows a side view of an alternate embodiment of the lightweight bag of FIG. 1 having a bottom pocket, with a loop hanger for removably attaching a bag for containing a roll of disposable waste bags.
Figure 6:
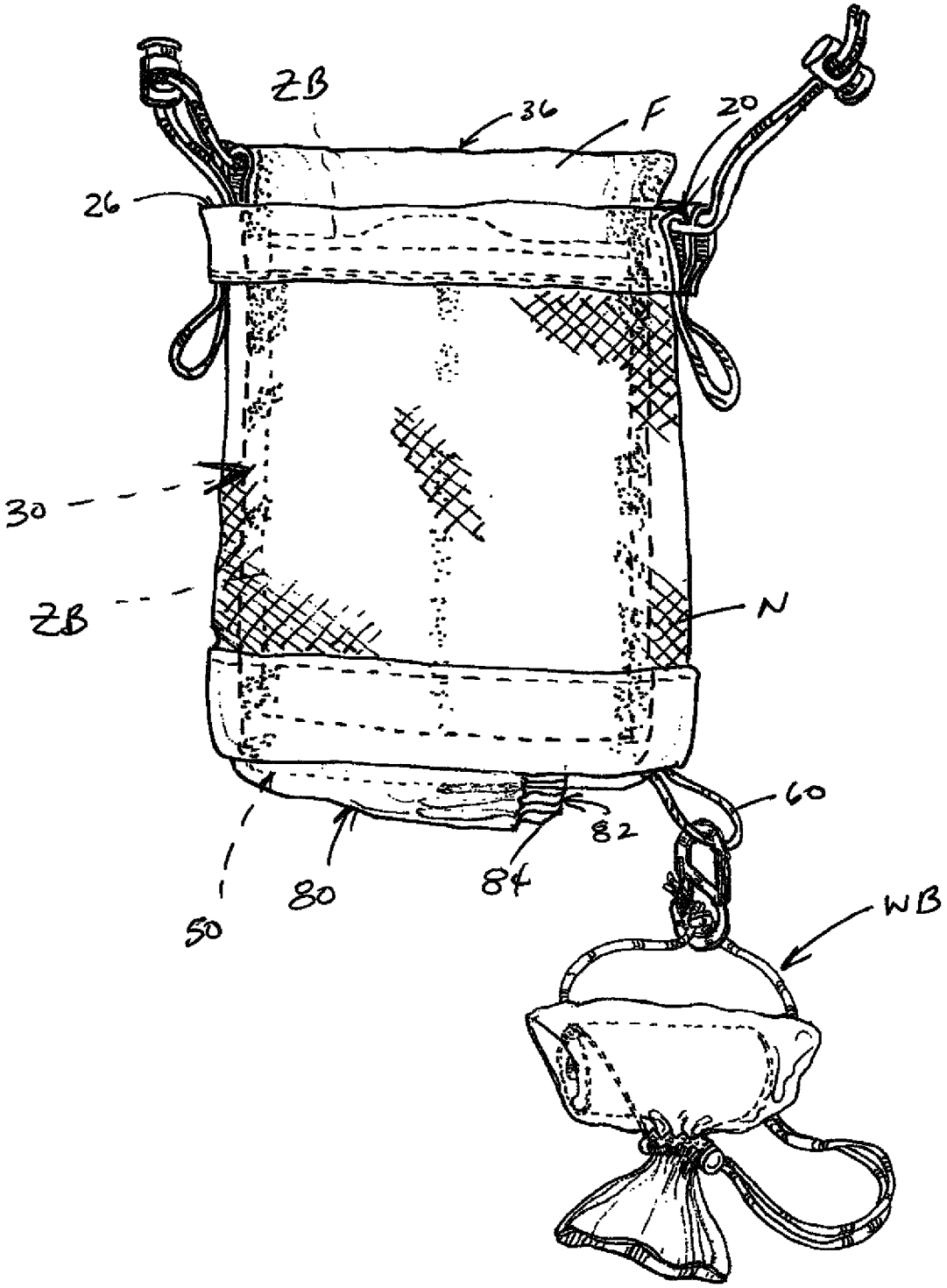
FIG. 6 shows a side view of another alternate embodiment of the lightweight bag with the bottom pocket of FIG. 5, but with a removable clip attached to a loop hanger for removably securing a bag for containing a roll of disposable waste bags.
Figure 8:
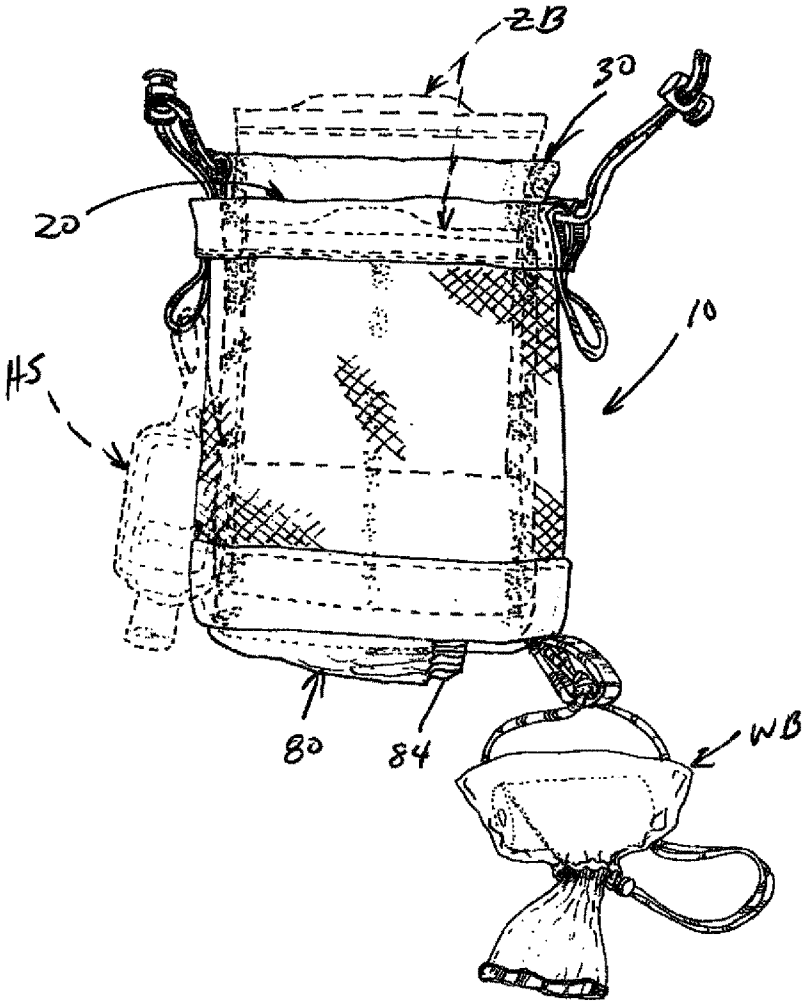
FIG. 8 shows the side view of the lightweight bag of FIG. 7, where the openings of both the first outer section and the second center section are open, and with a schematic illustration of a container of sanitizer removably attached to a loop hanger extending near the open drawstring opening of the first outer section.
Figure 7:
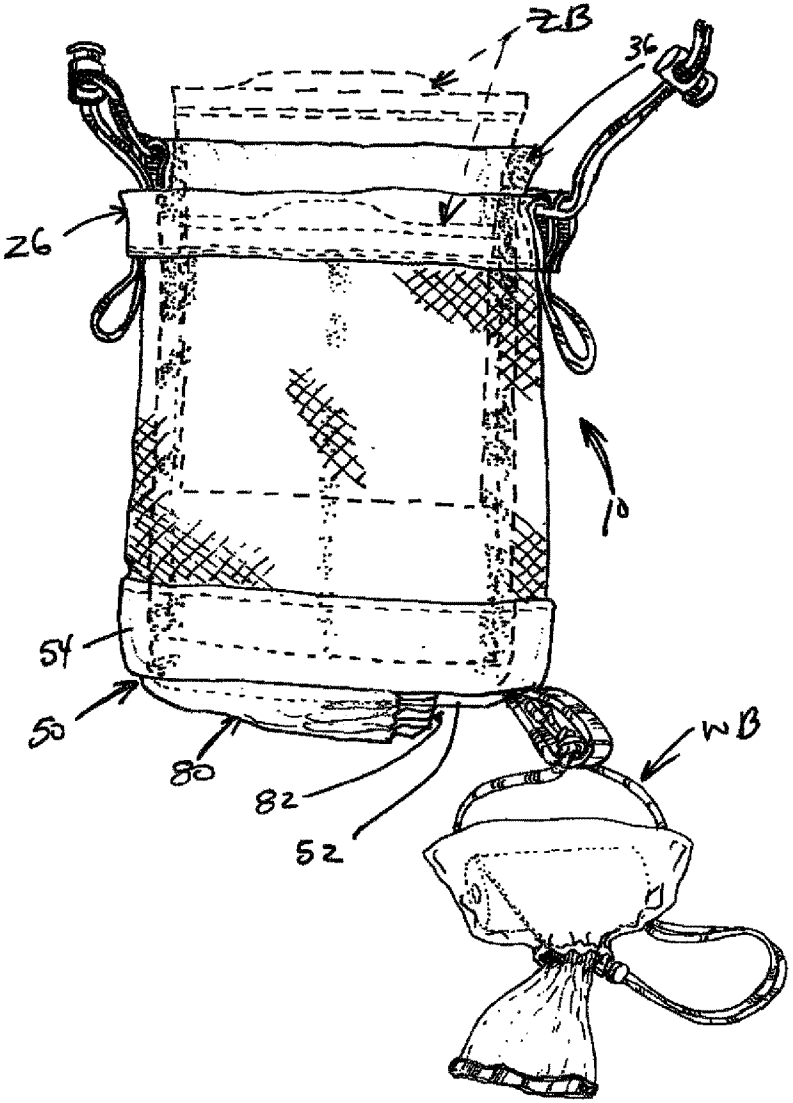
FIG. 7 shows a side view of the lightweight bag with a schematic illustration of the resealable bag protruding from the opening of the second center section, and a schematic illustration of a second resealable bag shown positioned below the opening of and within the second center section.

The walls 24, 34 of the first outer and second center sections 20, 30 are each or both secured along a shared or common, reinforced bottom 50. While the bottom 50 may be provided as a single panel construction, in the illustrated and preferred embodiment of FIGS. 2-4, the bag includes a common bottom 50 with a central portion 52 and a reinforcement portion 54. As best shown in FIG. 4, an outer edge 53 of the central portion 52 of the bottom 50 is secured to a lower edge 55 of the reinforcement portion 54 of the bottom, which is captured between the central portion 52 and the wall 34 of the second center section 30, by sewing the lower edge 55 of the reinforcement portion intermediate the central portion 52 and a bottom portion 35 of the wall 34 of the second center section 30. With this construction, the reinforcement portion 54 of the bottom 50 provides the first outer compartment 20 with the reinforcement portion 54 to resist damage to the bottom 50 from items P stored within the first outer compartment, such as a sharp small shovel. Where a bottom extending loop 60 is desired, still further layers of material are secured by sewing both ends 62 of the closed loop intermediate the central portion 52 and reinforcement portion 54 of the common bottom 50, as in FIG. 4.

The walls 24, 34 of the first outer and second center sections 20, 30 are also preferably each or both secured together at least at one location below and adjacent the drawstring openings 26, 36. While a double "bag-within-a-bag" construction of this type, secured solely with a common bottom may be provided, by securing or sewing the walls together at least at one location or seam 70, the sections or compartments 20, 30 of the bag 10 are secured together and the first outer section 20 is not able to be removed from a position surrounding the second center section 30. Such an internal seam 70 attachment between the walls 24, 34 has an advantage during use of the bag, where upon hanging the bag 10 from the drawstring 38 of the second center section 30, the first outer section 20 does not turn inside out, and inadvertently, under the weight of the items P contained, empty the contents of the first outer compartment 20 to the ground. Thus, three different configurations are contemplated. With the continuous compartment/common bottom construction, the first outer section or compartment is fully open and completely surrounding and around the second center section (forming an O-shaped compartment in cross-section). In a one-seam configuration, a single internal seam 70 is provided at one location between the first outer section 20 and second center section 30 walls (forming a C-shaped compartment in cross-section). In the illustrated embodiment of FIG. 4, a still further two-seam configuration is provided, with internal seams 70, 72 formed at two locations between the first outer section and second center section walls (forming two separate compartments 20*a*, 20*b* within the first outer section 20, or an "=" shaped compartment in cross-section), that enables personal items P to be separated during organization within the bag. The seams 70, 72, shown in FIG. 4 are shown by the cut-through sewing threads which join the walls 24, 34, at a location between the channels 27, 37 and the attachment of the reinforcement portion 54. The top of the seams 70, 72 are positioned below the material forming the drawstring opening 26 and channel 27, and extend downwardly along the walls 24, 34, preferably terminating above the reinforcement portion 54 of the bottom 50, as best seen in FIG. 4. As a result, toothpaste and a toothbrush might be located in one compartment 20*a* of the first outer section, while a shovel and toilet paper might be located in another compartment 20*b* of the first outer section 20, so that the toothbrush and shovel do not come in contact when stored within the bag 10.

The wall 34 of the second center section is preferably of lightweight opaque materials which are also referred to as super or ultra lightweight materials. Materials such as nylon or rip stop parachute-type or similar material for outdoor uses are preferred. The channels 27, 37 are also formed of a similar opaque lightweight material F. In the illustrated embodiment, the use of such super ultra light weight outdoor materials results in the empty bag 10, including all drawstrings and toggle locks, weighing approximately 0.5 ounces, or between 0.4 and 1.0 ounces. Additionally, opaque materials enable discretely housing either a separate and removable, resealable container ZB for used toilet paper, wipes and tampons, for example, or for housing soiled toilet trash materials directly. Using such fabric materials also enables the entire bag to be readily cleaned by washing within a washing machine. The preferred use is with a separate container ZB, as shown in phantom lines in FIGS. 5-8, which may be a resealable plastic bag(s), such as a disposable Ziploc® bag. By hiding and sealing toilet trash materials from view and smell within the second center section 30, or within a disposable bag ZB contained inside the opaque second center section, toilet trash materials are more easily managed and carried away from a wilderness site for proper disposal later.

The opaque lightweight flexible fabric bag material F of the second center section 30 may additionally include some weather resistance or waterproof characteristics, or need not be waterproofed or coated. However, by providing a weather resistant fabric bag material, the bag 10 resists external wet weather conditions and/or prevents leakage from exiting from the contents of the bag. The preferable use of an ultra lightweight open netting material N for the walls of the first outer section, in addition to enable viewing of the contents, also enables any moisture or dirt within the first outer section to exit the compartment through the open netting. Moisture from a damp toothbrush or wash cloth placed within one side of the first outer section 20 or compartment 20*a* following use, is permitted to evaporate through the open netting material. Additionally, any residual dirt on a cat hole shovel replaced within a second side 20*b* of the first outer section or compartment 20 following use, is able to fall out or be shaken out through the open netting material N.

Figure 11:
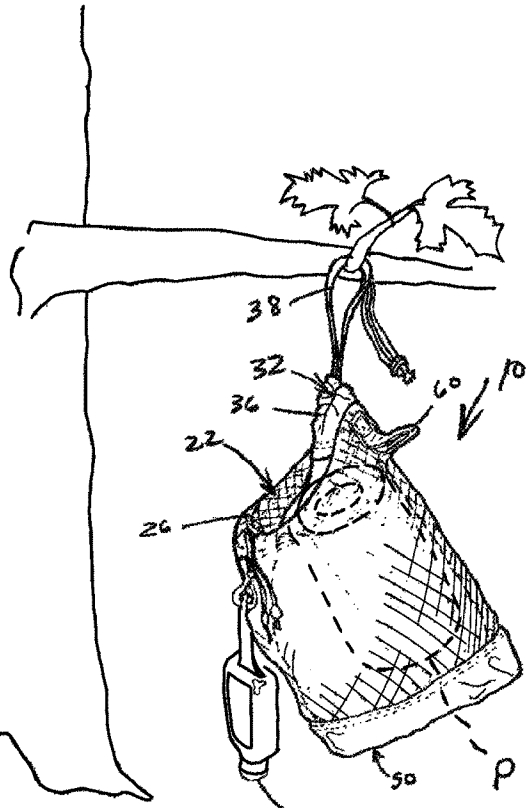
FIG. 11 shows a perspective side angled view of the bag of FIG. 1 conveniently hanging from a tree, and shown with the opening of the second center section in a closed position, and the first outer section shown in an open position for accessing personal items, such as toilet paper, which may be seen contained within the first outer section through the wall of the first outer section.

As previously described, multiple loop hangers 60 may be secured at various locations sewn within the seams of the first outer section 20, so the bag may be hung from a backpack, a tree branch or a hook within a restroom stall, as shown in FIG. 11. Other personal items may also be conveniently made available outside a backpack pocket by hanging them from top loop 60 on the bag 10 as in FIGS. 9-11. Such loop hangers retain the personal items attached to the bag for organizational purposes, but do not prevent them from being accessed during hiking. Examples include attaching a holder for a roll of disposable bags WB or a container of hand sanitizer HS. The combination of such organization and access features can save critical time on the trail, since disconnection from the bag may result in time spent searching within the dark depths of a backpack for the desired equipment.

In an alternate embodiment, an external pocket 80 may be provided on an outer surface of the bottom 50 to house additional equipment or personal items, such as a small roll of disposable bags or dog waste removal bags WB. As shown in FIGS. 5 to 8, the external pocket is formed by sewing a portion of panel forming the external pocket within the same seam securing the bottom 50 with the walls 24, 34 of the first outer and second center sections. An open portion 82 of the panel is provided which is not sewn to the bottom to provide access to the external pocket 80. The open portion 82 of the panel may include an elastic edge portion 84 to assist with securing items within the external pocket.

Although the bag of the present application has been described in detail sufficient for one of ordinary skill in the art to practice the invention, it should be understood that various changes, substitutions and alterations may be made without departing from the spirit or scope of the device as defined in the attached claims. Moreover, the scope of the present device is not intended to be limited to the specific embodiments described here, which are provided by way of example. As one of ordinary skill in the art will readily appreciate from the disclosure of the present device and its embodiments, other components and means presently existing or later to be developed that perform substantially the same function to achieve substantially the same result as those of the corresponding embodiments described here, may be utilized according to the present application. Accordingly, the appended claims are intended to include within their scope such other components or means.

I claim:

1. A lightweight, flexible, two-part bag for storing personal items comprising:

a first outer section or compartment, and a second center section or compartment formed substantially inside the first outer section or compartment, and the first and second sections or compartments are secured together surrounding a common bottom, together forming two separate compartments, and the common bottom comprises a central panel portion and a reinforcement panel portion, and the central panel portion of the common bottom is secured to the reinforcement panel portion of the common bottom;

the second center section or compartment has a wall of an ultra super lightweight opaque material to prevent viewing of items stored within the second center section or compartment, and the weight of the bag is approximately 1.0 ounce or less;

each of the first outer and second center sections or compartments has a drawstring opening surrounded by a channel housing a drawstring, the drawstring opening of the second center section or compartment extends above the drawstring opening of the first outer section or compartment; and ends of the drawstrings extend from each channel, and each drawstring opening is movable from an open position to a closed position when the ends of the drawstring are pulled in a direction away from the channel and portions of the channel are moved in a direction away from the ends of the drawstring to bunch the drawstring opening closed.

2. The bag of claim 1, wherein the first outer section or compartment has a wall of a transparent material or open netting material to enable viewing of personal items stored within the first outer section or compartment, and evaporation of moisture out of the first outer section or compartment.

3. The bag of claim 1, wherein the opaque material is designed for use in the outdoors.

4. The bag of claim 1, wherein the reinforcement panel portion of the common bottom is secured to and captured between the central portion of the common bottom and the wall of the second center section or compartment.

5. The bag of claim 4, wherein a wall of the first outer section or compartment is secured to the reinforcement panel portion of the common bottom.

6. The bag of claim 1, wherein the ends of the drawstrings exit from their respective channels at opposite positions around an open top of the first outer section or compartment and an open top of the second center section or compartment, to avoid confusion between, or tangling of, the drawstrings.

7. The bag of claim 1, wherein the ends of the drawstrings are secured together through and by a toggle lock clamp or stop for clamping the drawstrings within the channel and prevent movement of the channel with respect to the ends of the drawstrings and opening of the drawstring opening.

8. The bag of claim 1, wherein the common bottom of the bag includes an external pocket forming a third and open access compartment for storage of personal items or equipment.

9. The bag of claim 1, wherein a closed loop hanger is secured by permanently sewing ends of the closed loop adjacent to the channel housing of the drawstring opening of the first outer section or compartment, and the closed loop is positioned for use external to the first outer section or compartment.

10. The bag of claim 1, wherein the weight of the bag is approximately 0.5 ounces.

11. A bag having two compartments for storing personal items comprising:

a first outer section or compartment formed in part by a wall of a substantially transparent or open netting material to enable viewing and drying of personal items stored within the first outer section or compartment, a second center section or compartment formed in part by a wall of an opaque material to prevent viewing of items stored within the second center section or compartment, and the opaque material is a super ultra lightweight material and the weight of the bag is approximately 1.0 ounce or less, the second center section or compartment formed substantially inside the first outer section or compartment, and wherein the first and second sections or compartments are secured together along and surrounding a common bottom, together forming the two compartments;

each of the first outer and second center sections has a drawstring opening independently movable between an open position and a closed position, each drawstring opening is formed by a channel housing a drawstring, the drawstring opening of the second center section or compartment extends above the drawstring opening of the first outer section or compartment; and ends of the drawstrings extend from each channel, and exit from their respective channels at opposite positions around an open top of the first outer section or compartment and an open top of the second center section or compartment, to avoid confusion between, or tangling of, the drawstrings, with each drawstring opening movable from the open position to the closed position when the ends of the drawstring are pulled in a direction away from the channel and portions of the channel are moved in a direction away from the ends of the drawstring to bunch the drawstring opening closed.

12. The bag of claim 11, wherein a closed loop is secured by permanently sewing ends of the closed loop within a seam adjacent the channel housing of the drawstring opening of the first outer section or compartment, and the closed loop is positioned for use external to the first outer section or compartment.

* * * * *